US009544681B2

(12) United States Patent
Kim et al.

(10) Patent No.: US 9,544,681 B2
(45) Date of Patent: Jan. 10, 2017

(54) ACOUSTIC DEFLECTOR FOR OMNI-DIRECTIONAL SPEAKER SYSTEM

(71) Applicant: Bose Corporation, Framingham, MA (US)

(72) Inventors: Wontak Kim, Watertown, MA (US); George E. P. Chute, Milford, MA (US)

(73) Assignee: Bose Corporation, Framingham, MA (US)

( * ) Notice: Subject to any disclaimer, the term of this patent is extended or adjusted under 35 U.S.C. 154(b) by 45 days.

(21) Appl. No.: 14/643,216

(22) Filed: Mar. 10, 2015

(65) Prior Publication Data

US 2016/0227315 A1 Aug. 4, 2016

Related U.S. Application Data

(60) Provisional application No. 62/110,493, filed on Jan. 31, 2015.

(51) Int. Cl.
*H04R 1/34* (2006.01)
*H04R 1/28* (2006.01)

(52) U.S. Cl.
CPC ..... *H04R 1/345* (2013.01); *H04R 1/2819* (2013.01)

(58) Field of Classification Search
CPC ..... H04R 1/345; H04R 2201/34; H04R 1/30; H04R 1/2819
See application file for complete search history.

(56) References Cited

U.S. PATENT DOCUMENTS 3,912,866 A * 10/1975 Fox ..... H04R 1/2865 181/155
4,322,578 A * 3/1982 Selmin ..... H04R 1/345 181/175
4,348,549 A * 9/1982 Berlant ..... H04R 1/26 181/152
5,115,882 A * 5/1992 Woody ..... H04R 1/345 181/144
6,026,928 A * 2/2000 Maharaj ..... H04R 1/30 181/152
6,257,365 B1 * 7/2001 Hulsebus, II ..... H04R 1/34 181/155

(Continued)

OTHER PUBLICATIONS

McRitchie, Don, "Aquarius: A Noble Experiment", Audoheritage.com, 2001, accessed Mar. 5, 2015, 9 pages.

*Primary Examiner* — Matthew Eason
(74) *Attorney, Agent, or Firm* — Schmeiser, Olsen & Watts LLP; William G. Guerin

(57) ABSTRACT

An omni-directional acoustic deflector includes an acoustically reflective body having a truncated conical shape including a substantially conical outer surface, a top surface and a cone axis, the acoustically reflective body having an opening in the top surface centered on the cone axis. An acoustic absorber is disposed at the opening in the top surface. The deflector may also include at least one opening disposed along a circumference of the substantially conical outer surface at a cone radius associated with a pressure maximum of an acoustic resonance mode with an acoustic absorber at each such opening. Speaker systems employing the omni-directional acoustic deflector have an improved high frequency acoustic spectrum response regardless of the location of the listener with respect to the speaker system.

28 Claims, 11 Drawing Sheets

(56) References Cited

U.S. PATENT DOCUMENTS

| | | | | |
|---|---|---|---|---|
| 6,597,797 | B1 * | 7/2003 | Betts | H04R 1/345 181/155 |
| 8,130,994 | B2 * | 3/2012 | Button | H04R 1/24 181/155 |
| 8,290,195 | B2 * | 10/2012 | Chick | H04R 1/36 181/175 |
| 8,418,802 | B2 * | 4/2013 | Sterling | H04R 1/345 181/167 |
| 8,467,557 | B2 * | 6/2013 | Miller | H04R 1/24 381/182 |
| 8,672,088 | B2 * | 3/2014 | Sterling | H04R 1/345 181/167 |
| 8,750,540 | B2 * | 6/2014 | Tan | H04R 1/345 181/144 |
| 9,282,398 | B2 * | 3/2016 | Monroe | H04R 1/22 |
| 2008/0192972 | A1 * | 8/2008 | Lewallen | H04R 23/00 381/343 |
| 2014/0321686 | A1 * | 10/2014 | Wegener | H04R 1/028 381/332 |

* cited by examiner

ACOUSTIC DEFLECTOR FOR OMNI-DIRECTIONAL SPEAKER SYSTEM

RELATED APPLICATION

This application claims benefit from U.S. Provisional Patent Application No. 62/110,493, filed Jan. 31, 2015 and titled "Acoustic Deflector for Omni-Directional Speaker System," the contents of which are incorporated herein by reference.

BACKGROUND

Conventional acoustic deflectors in speaker systems can exhibit artifacts in the acoustic spectrum due to acoustic modes present between a speaker and an acoustic deflector. This disclosure relates to an acoustic deflector for equalizing the resonant response for an omni-directional speaker system.

SUMMARY

In one aspect, an omni-directional acoustic deflector includes an acoustically reflective body having a truncated conical shape including a substantially conical outer surface, a top surface and a cone axis. The acoustically reflective body has an opening in the top surface centered on the cone axis. The omni-directional acoustic deflector also includes an acoustically absorbing material disposed at the opening in the top surface.

Embodiments may include one of the following features, or any combination thereof. The substantially conical outer surface may comprise a non-linear slant profile and may be defined by a truncated hyperboloid of revolution. At least one non-circularly symmetric surface can radially extend from the substantially conical outer surface. The acoustically absorbing material can be a foam or an acoustically absorbing fabric. The acoustically reflective body can include at least one opening disposed along a circumference of the substantially conical outer surface at a cone radius associated with a pressure maximum of an acoustic resonance mode. An acoustically absorbing material can be disposed in the one or more openings. The acoustically reflective body can have an opening extending around a circumference of the conical outer surface at a cone radius associated with a pressure maximum of an acoustic resonance mode. The acoustic resonance mode can be a circularly symmetric mode. An acoustically absorbing material can be disposed at the opening that extends around the circumference of the conical outer surface.

In another aspect, a speaker system includes an acoustic enclosure, a downward firing acoustic driver disposed within the acoustic enclosure and an omni-directional acoustic deflector. The omni-directional acoustic deflector is disposed in the acoustic enclosure below the acoustic driver to receive acoustic energy propagating from the acoustic driver. The omni-directional acoustic deflector includes an acoustically reflective body having a truncated conical shape including a substantially conical outer surface, a top surface and a cone axis. The acoustically reflective body has an opening in the top surface centered on the cone axis. The omni-directional acoustic deflector further includes an acoustically absorbing material disposed at the opening in the top surface.

Embodiments of the speaker system may include one of the above and/or below features, or any combination thereof. The speaker system may include at least one passive radiator. The acoustic enclosure can include a pair of opposing passive radiators configured to be driven by audio signals from an audio source such that each opposing pair of passive radiators are driven acoustically in phase with each other and mechanically out of phase with each other, to minimize vibration of the acoustic enclosure.

In another aspect, a speaker system includes an acoustic enclosure, a downward firing acoustic driver disposed within the acoustic enclosure, a first omni-directional acoustic deflector and a second omni-directional acoustic deflector. The first omni-directional acoustic deflector is disposed in the acoustic enclosure below the downward firing acoustic driver to receive acoustic energy and the second omni-directional acoustic deflector is disposed in the acoustic enclosure above the upward firing acoustic driver to receive acoustic energy. Each of the first and second omni-directional acoustic deflectors includes an acoustically reflective body having a truncated conical shape including a substantially conical outer surface, a top surface and a cone axis. Each acoustically reflective body has an opening in the top surface centered on the cone axis. Each of the omni-directional acoustic deflectors further includes an acoustically absorbing material disposed at the opening in the top surface. Embodiments of the speaker system may include one of the above features, or any combination thereof.

DETAILED DESCRIPTION

Multiple benefits are known for omni-directional speaker systems. These benefits include a more spacious sound image when the speaker system is placed near a boundary, such as a wall within a room, due to reflections. Another benefit is that the speaker system does not have to be oriented in a particular direction to achieve optimum high frequency coverage. This second advantage is highly desirable for mobile speaker systems where the speaker system and/or the listener may be moving.

Figure 1A:
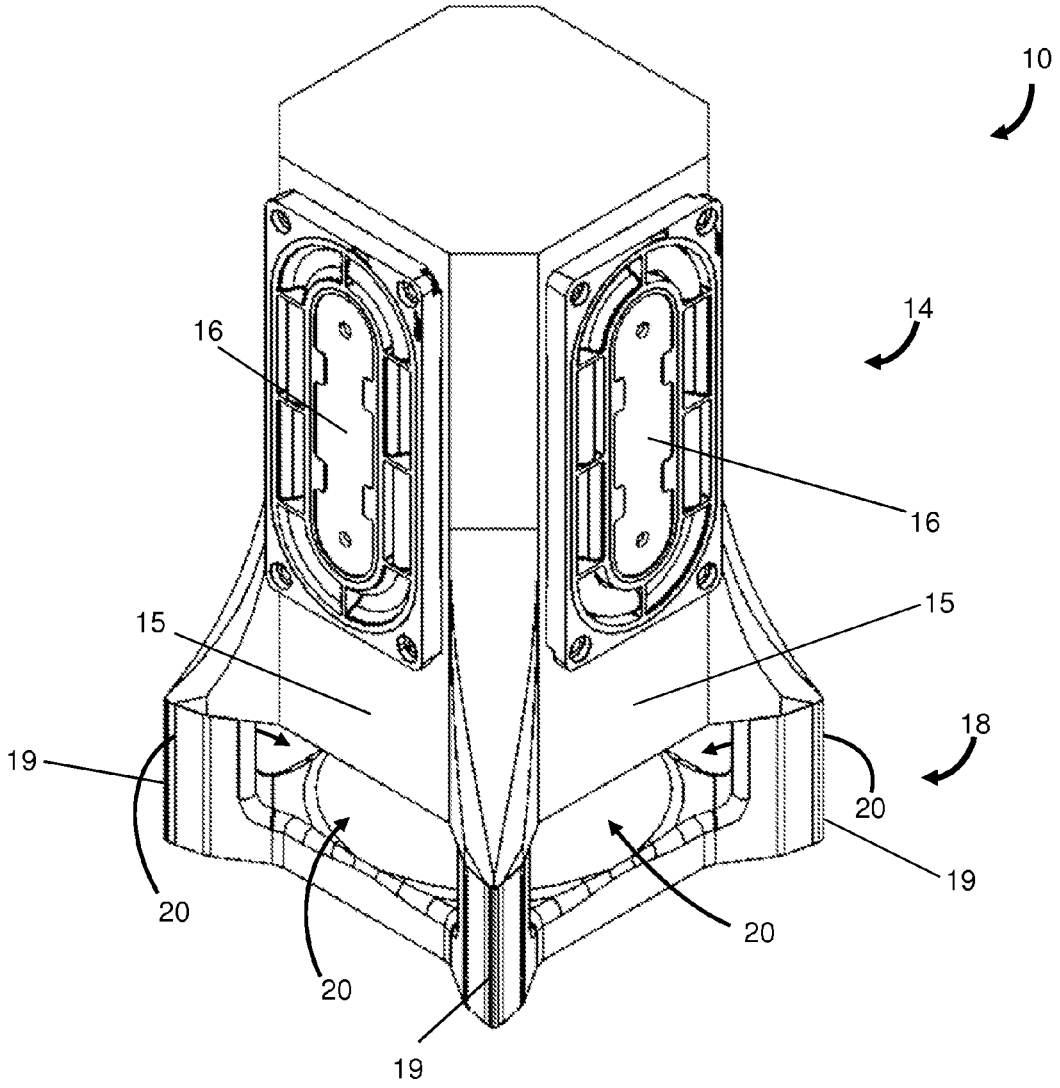
FIG. 1A is a perspective view of an omni-directional speaker system having a single acoustic driver inside a vertical acoustic enclosure.
Figure 1B:
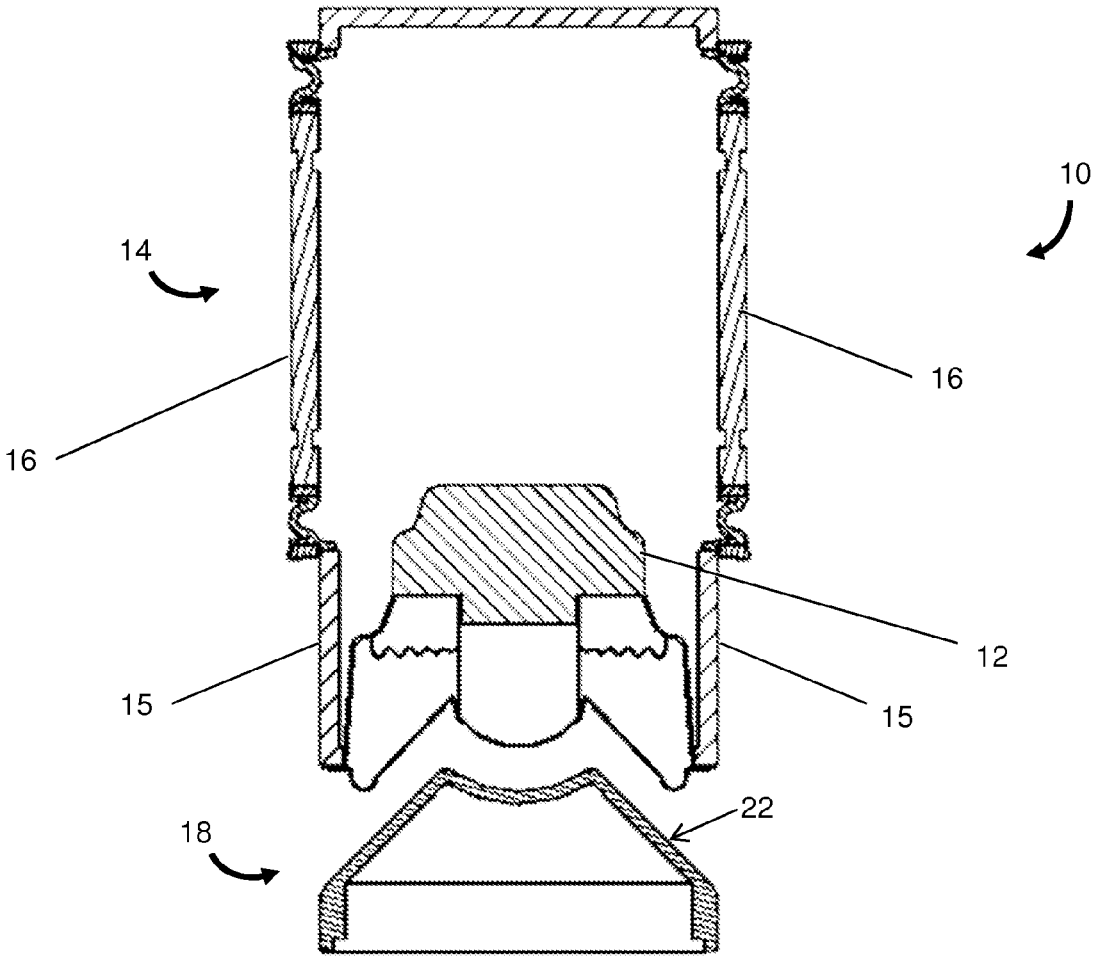
FIG. 1B is a cross-sectional view of the omni-directional speaker system shown in FIG. 1A.
Figure 1C:
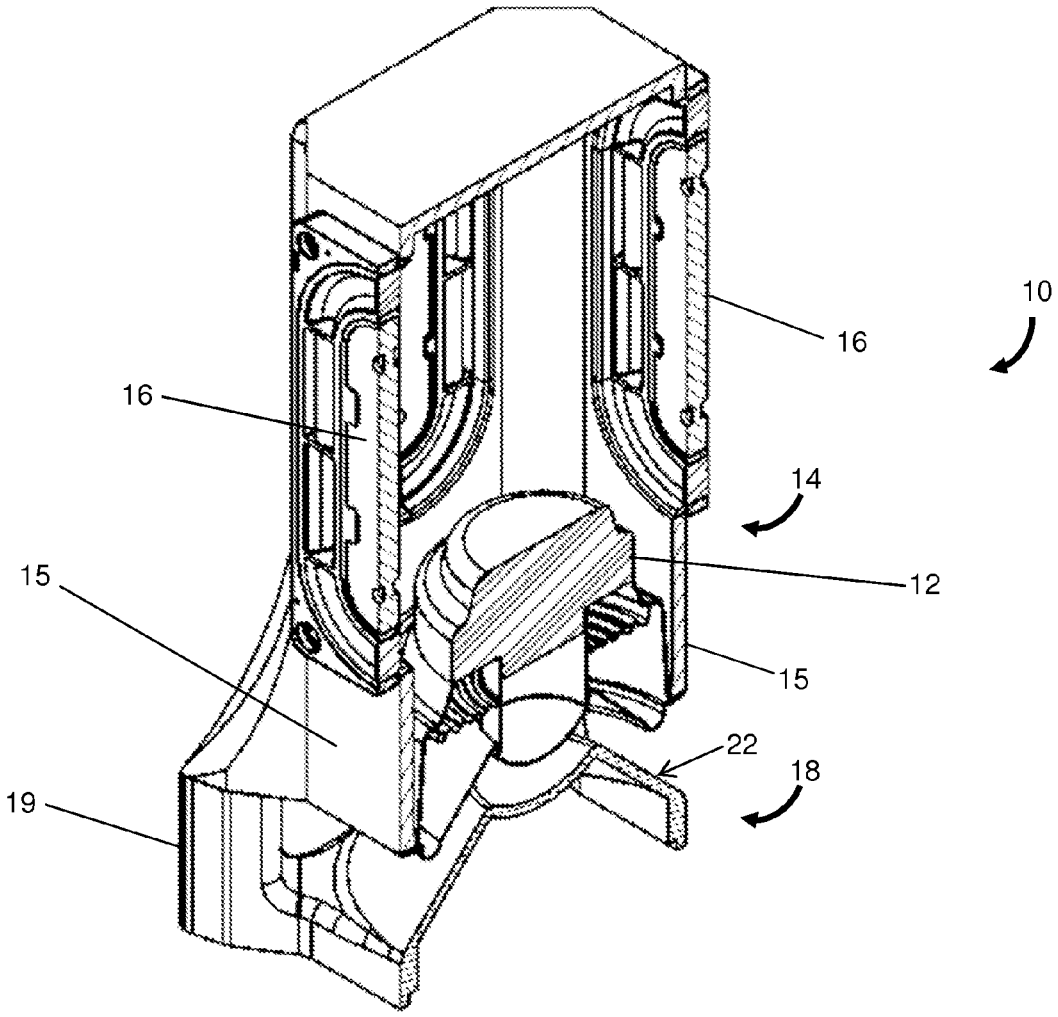
FIG. 1C is a perspective cut-away view of the omni-directional speaker system shown in FIG. 1A.

FIGS. 1A, 1B and 1C are drawings showing a perspective view, cross-sectional view and perspective cut-away view, respectively, of a speaker system 10 that includes a single downward firing acoustic driver 12 secured to a vertical acoustic enclosure 14. Each side wall 15 of the enclosure 14 includes a passive radiator 16. In some examples, two opposing passive radiators 16 are configured to be driven by audio signals from an audio source (not shown) such that each opposing pair of passive radiators 16 are driven acoustically in phase with each other and mechanically out of phase with each other, to minimize vibration of the enclosure 14. Two opposing pairs of passive radiators 16 (for a total of four passive radiators) may be used, as shown in the figures. The passive radiators 16 may be located on an outer wall 15 of the enclosure 14, as depicted, or instead be located within the enclosure 14 and configured to radiate acoustic energy through slots located in the enclosure 14 (not shown). One or more of the passive radiators 16 may be oriented vertically or horizontally within the enclosure 14. The volume within the region above the acoustic driver 12 and inside the enclosure 14, as "sealed" with the passive radiators 16, defines an acoustic chamber. The diaphragms of the passive radiators 16 are driven by pressure changes within the acoustic chamber. The speaker system 10 also includes an omni-directional acoustic deflector 18 having four vertical legs 19 to which the enclosure 14 is mounted. Acoustic energy generated by the acoustic driver 12 propagates downward and is deflected into a nominal horizontal direction by a substantially conical outer surface 22 of the inner portion of the acoustic deflector 18. There are four substantially rectangular openings 20. Each opening 20 is defined by the base of the enclosure 14, the base of the acoustic deflector 18 and a pair of the vertical legs 19. These four openings 20 are acoustic apertures which pass the horizontally propagating acoustic energy. It should be understood that the propagation of the acoustic energy in a given direction includes a spreading of the propagating acoustic energy, for example, due to diffraction.

Figure 2:
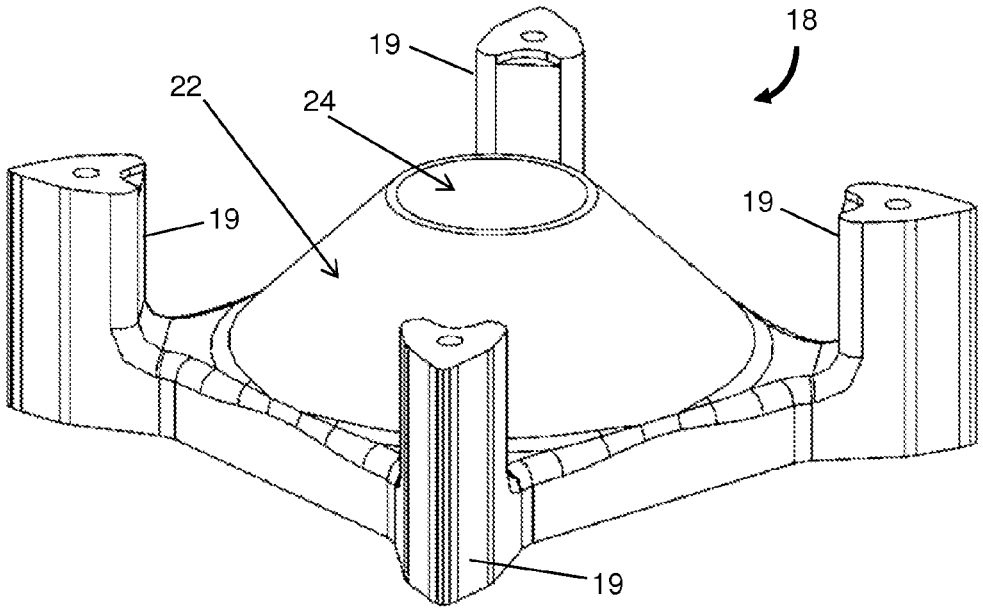
FIG. 2 is a perspective view of the omni-directional acoustic deflector in the speaker system of FIG. 1A.
Figure 3A:
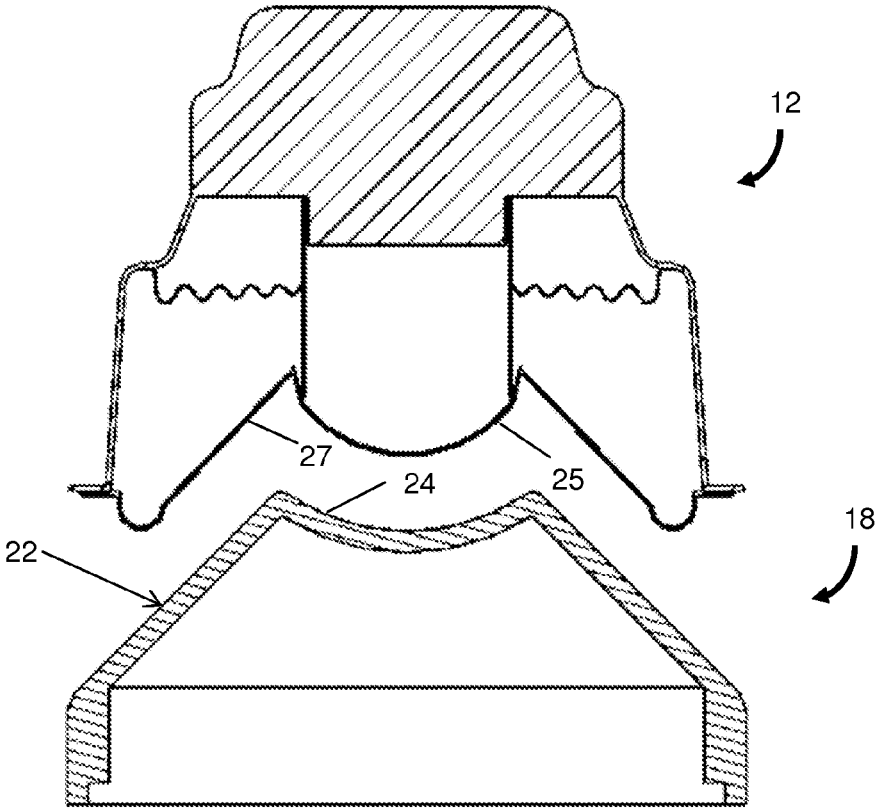
FIG. 3A is a cross-sectional view of the omni-directional acoustic deflector and the acoustic driver in the speaker system of FIG. 1A.
Figure 3B:
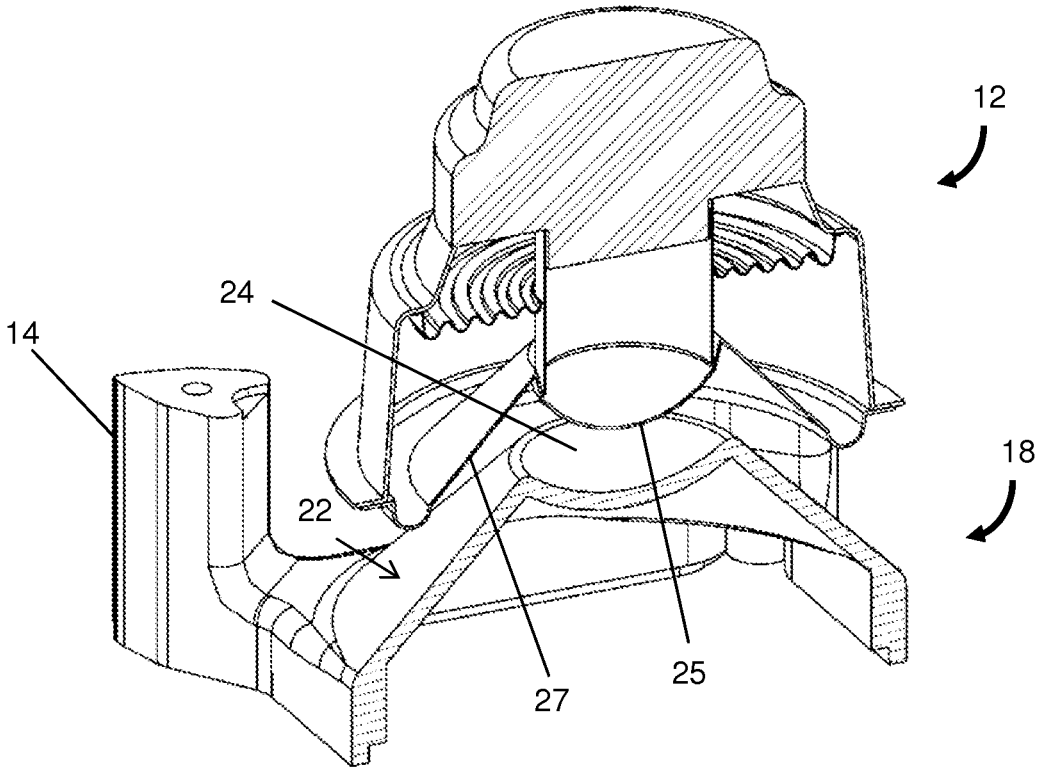
FIG. 3B is a perspective cut-away view of the omni-directional acoustic deflector and the acoustic driver in the speaker system of FIG. 1A.

FIG. 2 is a perspective view of the omni-directional acoustic deflector 18 showing the conical outer surface 22 and a top surface 24. Reference is also made to FIG. 3A and FIG. 3B which show a cross-sectional view and a perspective cut-away perspective view, respectively, of the omni-directional acoustic deflector 18 and the acoustic driver 12. The top surface 24 of the acoustic deflector 18 is shaped to accommodate the excursions of a central dust cap 25, centered on the face 27 of the acoustic driver 12, during operation of the speaker system. The conventional conical shape of the acoustic deflector 18 results in significant colorization of the acoustic spectrum, especially at higher acoustic frequencies as shown by the dashed curve 26 in FIG. 4, due to resonances in the volume between the face 27 and dust cap 25 of the acoustic driver 12 and the conical outer surface 22 and top surface 24 of the acoustic deflector 18.

Figure 5A:
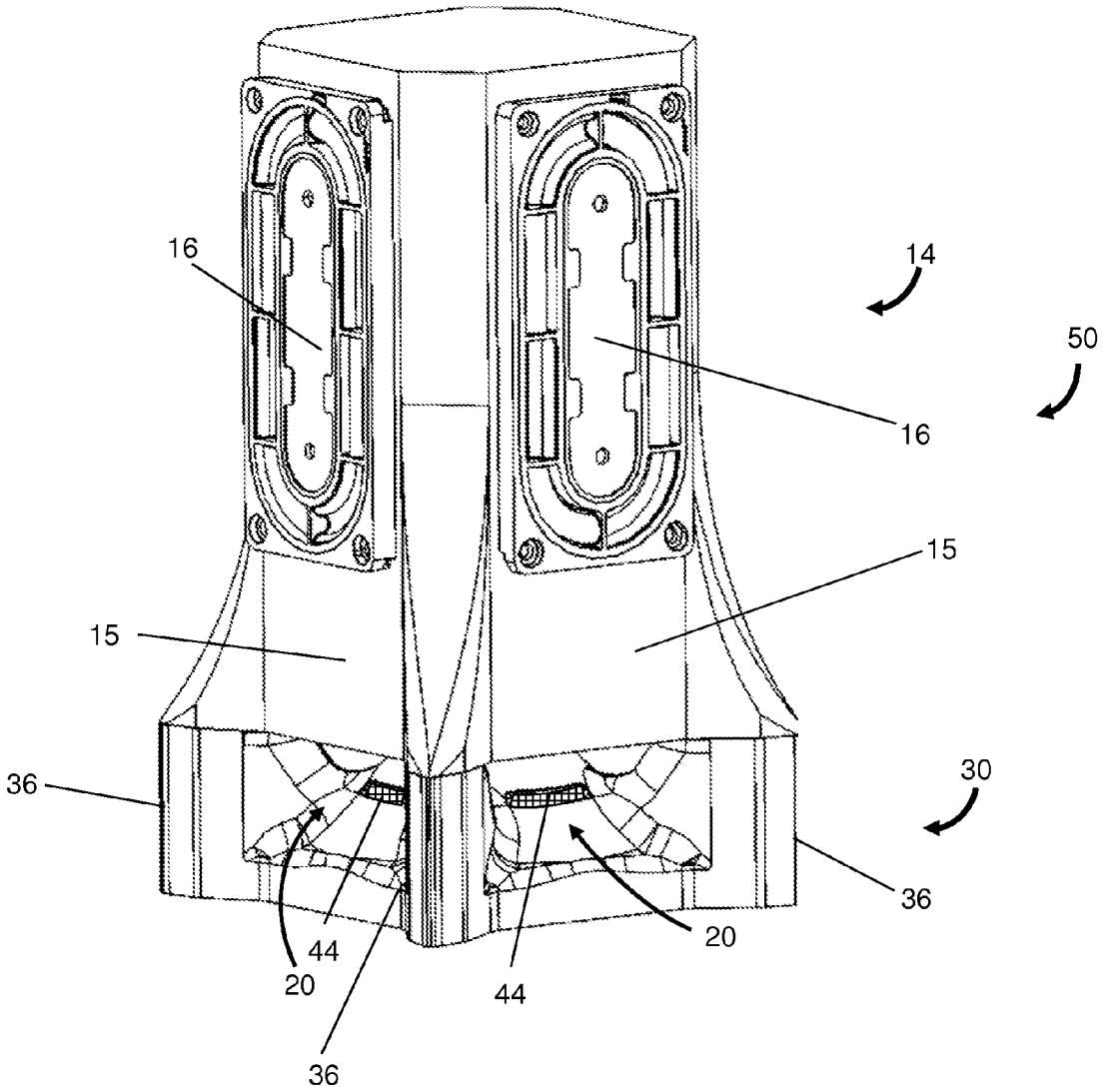
FIG. 5A is a perspective view of one example of an omni-directional speaker system having an omni-directional acoustic deflector to reduce the negative effects of resonances on the acoustic spectrum according to principles described herein.
Figure 5B:
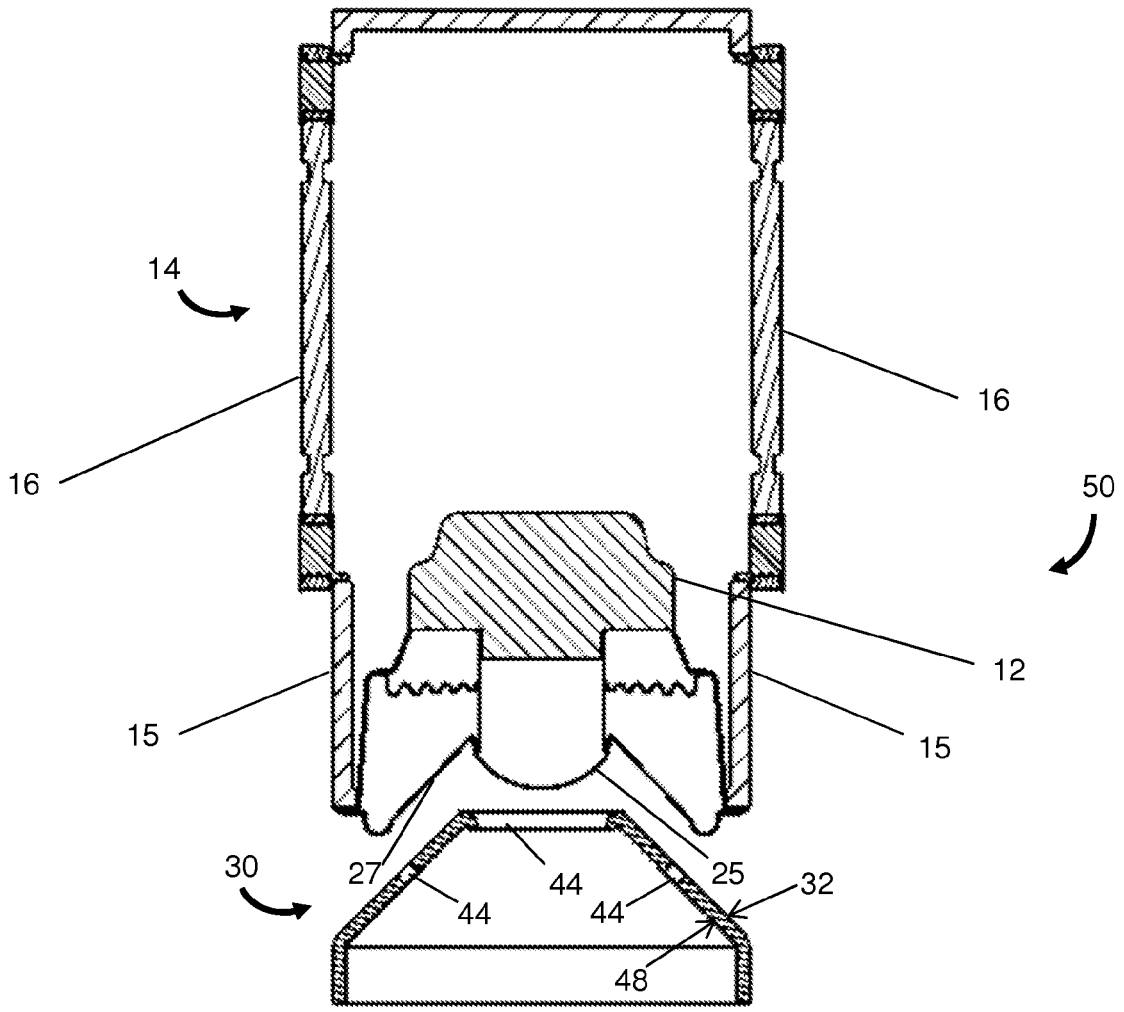
FIG. 5B is a cross-sectional view of the omni-directional speaker system of FIG. 5A.
Figure 5C:
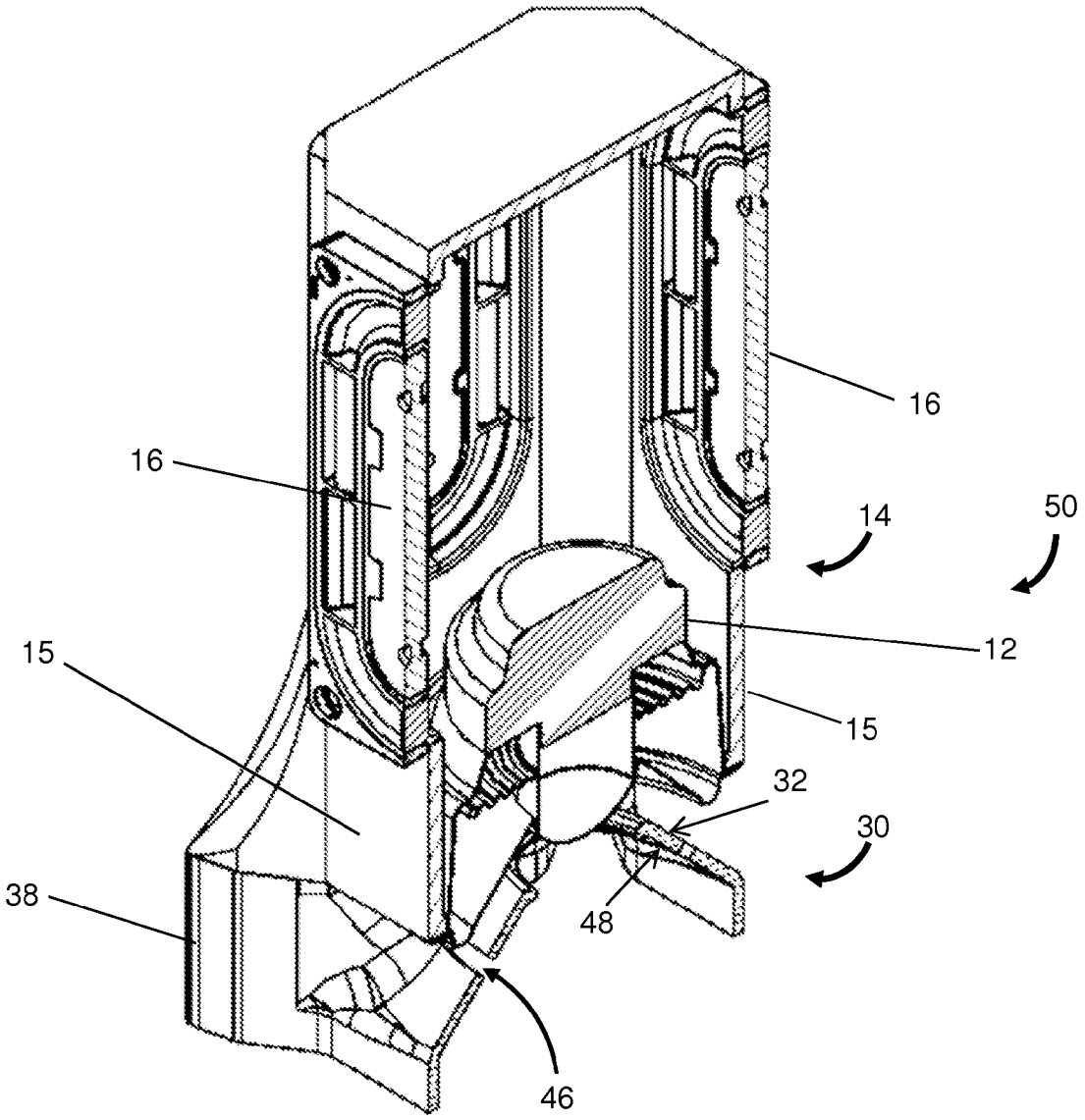
FIG. 5C is a perspective cut-away view of the omni-directional speaker system of FIG. 5A.

FIGS. 5A, 5B and 5C are illustrations showing a perspective view, cross-sectional view and perspective cut-away view, respectively, of an example of an omni-directional speaker system 50 having an omni-directional acoustic deflector 30 disposed below a single downward firing acoustic driver 12. The omni-directional acoustic deflector 30 is configured to reduce the negative effects of resonances on the acoustic spectrum as described below. The illustrated speaker system 50 is substantially similar to the speaker system 10 shown in FIGS. 1A, 1B and 1C except for the omni-directional acoustic deflector 30 which has different structural and material features.

Figure 4:
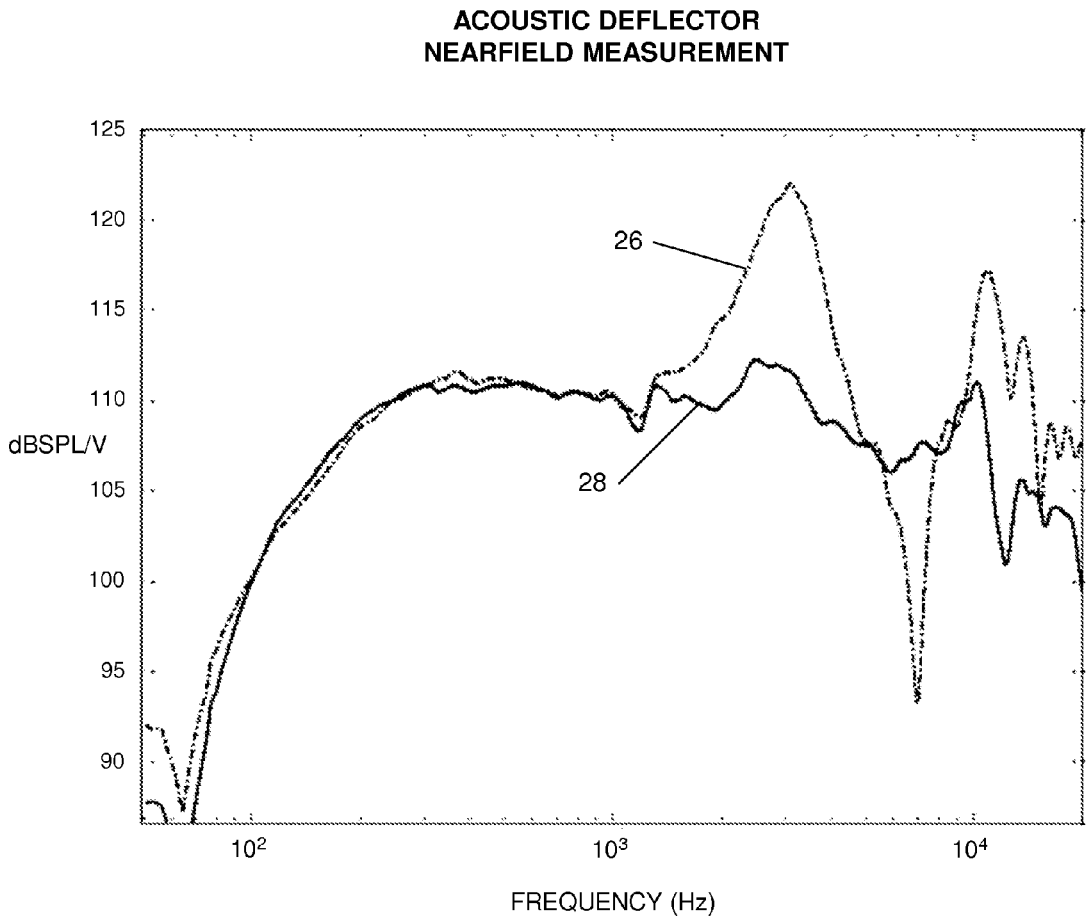
FIG. 4 is a plot of the acoustic nearfield energy level as a function of acoustic frequency for a conventional omni-directional acoustic reflector and one example of an omni-directional acoustic deflector according to the principles described herein.
Figure 6A:
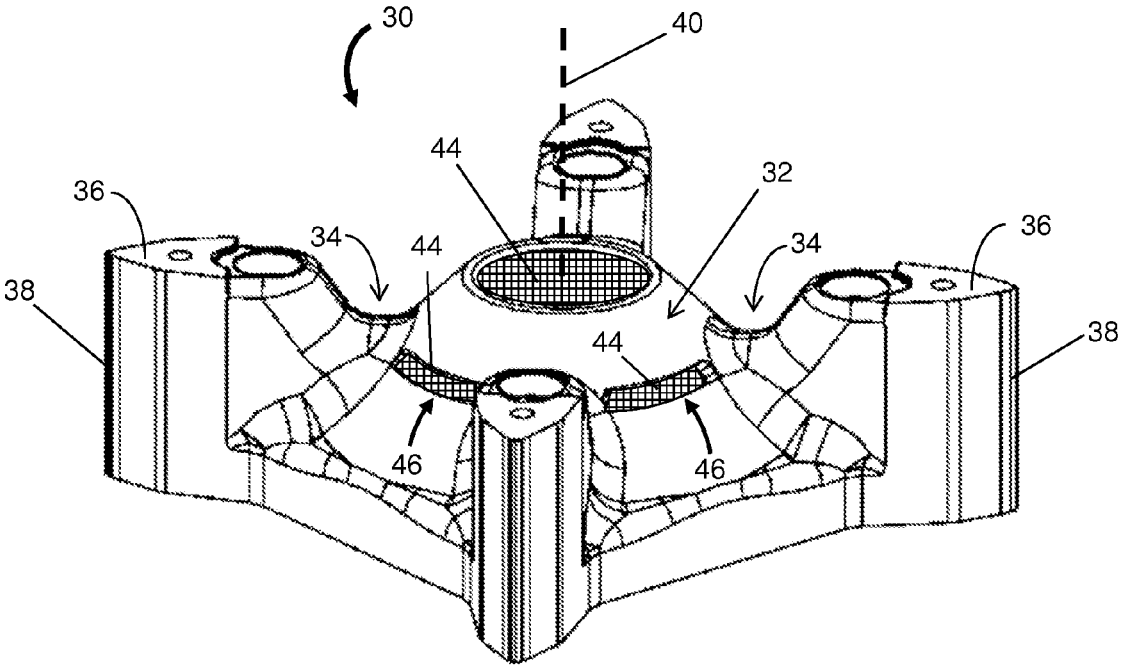
FIG. 6A is a perspective view of the omni-directional acoustic deflector in the omni-directional speaker system of FIG. 5A and shows regions of acoustically absorbing material.
Figure 6B:
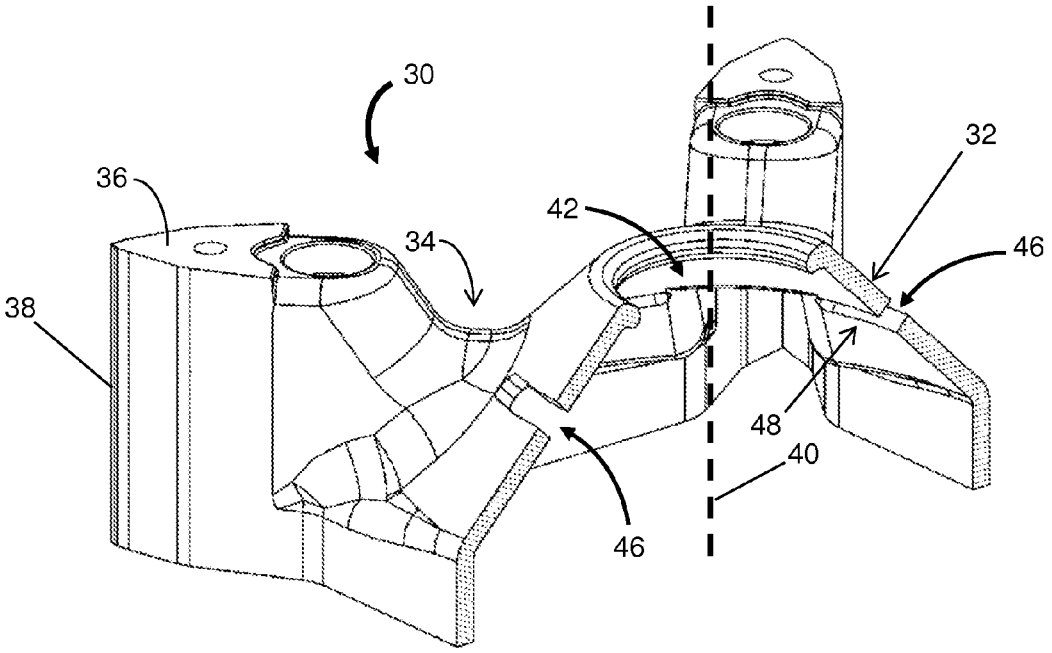
FIG. 6B is a perspective cut-away view of the omni-directional acoustic deflector shown in FIG. 6A without the regions of acoustically absorbing material.

FIG. 6A is a perspective view of the omni-directional acoustic deflector 30 and includes regions having acoustically absorbing material 44 as described below. FIG. 6B is a cut-away perspective view of the omni-directional acoustic deflector 30 shown without the absorbing material 44. Referring also to FIG. 4, the solid curve 28 shows the acoustic spectrum that is achieved with the illustrated omni-directional speaker system 50 with the acoustic deflector 30. A comparison with the dashed curve 26, which represents the acoustic spectrum for the speaker system 10 having the omni-directional acoustic deflector 18 of FIG. 2, demonstrates the improved performance (i.e., flatter spectrum) resulting from use of the acoustic deflector 30. Performance at longer acoustic wavelengths (e.g., frequencies below approximately 1 KHz) is not significantly different.

The illustrated acoustic deflector 30 has a nominal truncated conical shape. In other examples, the slope of the conical outer surface 32 between the base and vertex of the cone is not constant. For example, the surface 32 may have a non-linear slant profile such as a parabolic profile or a profile described by a truncated hyperboloid of revolution. The body of the acoustic deflector 30 can be made of any suitably acoustically reflective material. For example, the body may be formed from plastic, stone, metal or other rigid material, or any suitable combinations thereof.

In the illustrated example, the omni-directional acoustic deflector 30 includes two features which contribute to the improvement in the acoustic spectrum. First, there are radial extensions 34 from the conical outer surface 32 to the mounting surfaces 36 of the four legs 38. These "bridging" extensions 34 in the body of the acoustic deflector 30 disrupt the circular symmetry of the acoustically reflective surface and thereby reduce or eliminate the ability of the volume between the acoustic driver 12 and the acoustic deflector 30 to support circularly symmetric modes. In other examples, the numbers of legs 38 and extensions 34, or other features radially extending from the axis (vertical dashed line 40) of the cone, are different.

The second feature of the omni-directional acoustic deflector 30 that results in an improvement in the acoustic spectrum is the presence of acoustically absorbing regions disposed along the acoustically reflective surface. FIG. 6B shows one of these regions at an opening 42 centered on the cone axis 40 at the top of the truncated cone in which acoustically absorbing material 44 is disposed (FIG. 6A). This acoustically absorbing material 44 attenuates the acoustic energy present near and at the peak of the lowest order circularly symmetric resonance mode. In some implementations, the diameter of the opening 42 is chosen so that the resulting attenuation of the acoustic energy propagating from the speaker 12 is limited to an acceptable level while achieving a desirable level of smoothing of the acoustic spectrum.

Additional openings 46 in the form of slots, each containing acoustically absorbing material 44, are located along portions of a circumference of the nominal conical outer surface 32. In one example, the circumference is at a cone radius that corresponds to a pressure maximum of a circularly symmetric acoustic resonance mode. For example, the circumference may be at a peak of the second harmonic of the resonance mode. In another example, the circumference is at a radius that is approximately one-half the base radius of the cone.

In an alternative example, the radial extensions 34 extend from the mounting surfaces 36 to the nominal conical outer surface 32 below the circumference of the slotted openings 46 to thereby permit a single opening extending 360° along the circumference. In this example, upper and lower portions of the conical outer surface 32 are separated by the single opening. For support, one or more structural features inside the body cavity may be used to support the upper portion.

In various implementations, the acoustically absorbing material 44 is a foam. In one example, the open region in the body cavity of the acoustic deflector 30, shown in FIG. 6B beneath the cone, is filled with a single volume of foam such that the foam is adjacent to, or extends into, the openings 42 and 46. Alternatively, a separate foam element may be disposed at each opening 42 and 46 so that only a portion of the body cavity is occupied by foam. In one example, the foam is coated with a water resistant material. In one implementation, the foam present at the central opening 42 is at one end of a cylindrically-shaped foam element disposed within the body cavity.

In another example, the acoustically absorbing material 44 is an acoustically absorbing fabric or screen. The fabric may be disposed within the openings 42 and 46 or inside the internal cavity of the cone adjacent to each opening 42 or 46. The fabric is acoustically transparent to a degree; however, the acoustic resistance can be tune by using different fabrics. Advantageously, the fabric avoids the need for using one or more large volumes of foam as the inside surface of the conical portion of the acoustic deflector body (opposite surface 32) can be lined with the fabric. In addition, the fabric can be water resistant without the need to apply a water resistant coating. One example of a suitable fabric for some implementations is Saatifil Acoustex 145 available from SaatiTech U.S.A. of Somers, N.Y.

Advantageously, leaving at least a portion of the volume of the cavity within the acoustic deflector body unoccupied by the acoustically absorbing material 44 enables the unoccupied volume to be populated by other system components, such as electronic components, and can thereby reduce the size of the omni-directional speaker system 50.

Figure 7:
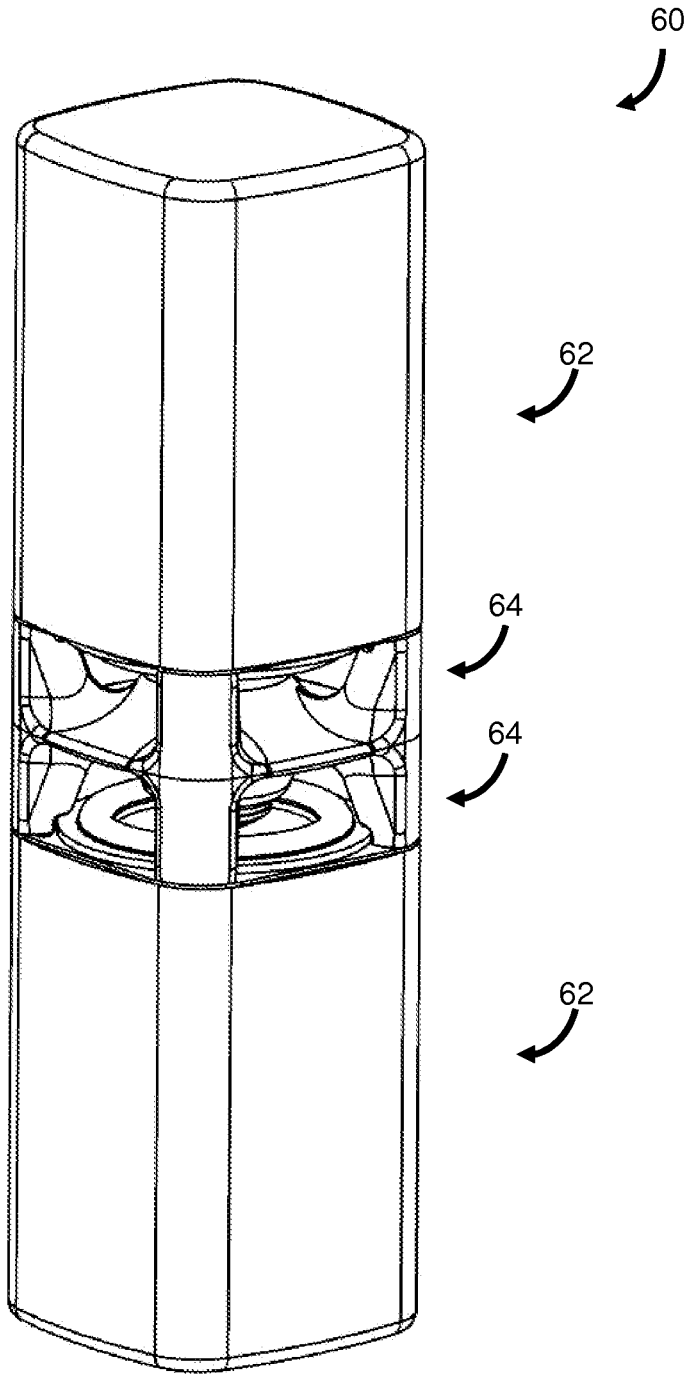
FIG. 7 is a perspective view of an example of an omni-directional satellite speaker system having a pair of acoustic drivers and a pair of omni-directional acoustic deflectors to reduce the negative effects of resonances on the acoustic spectrum according to principles described herein.

In another implementation shown in FIG. 7, an omni-directional satellite speaker system 60 includes a pair of acoustic drivers. Each acoustic driver is secured inside a vertical acoustic enclosure 62. One of the acoustic drivers is configured to provide acoustic energy in an upward direction and the other acoustic driver is positioned to face in an opposite direction so that acoustic energy propagates in a downward direction. The system also includes two omni-directional acoustic deflectors 64, each positioned near the face of a respective one of the acoustic drivers and having acoustic acoustically absorbing material as described in the various examples above. Such a system can be compact and narrow, with the vertical dimension being the longest dimension. In one example, the omni-directional satellite speaker system 60 includes two speaker subsystems, each similar to the speaker system 50 shown in FIG. 5A. One of the speaker subsystems is vertically inverted and adjacent to the other speaker subsystem. An omni-directional satellite speaker system configured in this way can employ smaller active drivers to achieve the same acoustic output of a single active driver system and therefore can have a smaller footprint.

In general, omni-directional acoustic deflectors according to principles described herein act as an acoustic smoothing filter by providing a modified acoustic resonance volume between the speaker and the acoustic deflector. It will be appreciated that adjusting the size and locations of the acoustically absorbing regions allows for the acoustic spectrum to be tuned to modify the acoustic spectrum. Similarly, the profile of the acoustically reflecting surface may be non-linear (i.e., vary from a perfect conical surface) and defined so as to modify the acoustic spectrum. In addition, non-circularly symmetric extensions in the acoustically reflecting surface, such as the radial extensions described above, can be utilized to achieve an acceptable acoustic spectrum.

A number of implementations have been described. Nevertheless, it will be understood that additional modifications may be made without departing from the scope of the inventive concepts described herein.

What is claimed is:

1. An omni-directional acoustic deflector, comprising:

an acoustically reflective body having a truncated conical shape including a substantially conical outer surface, a top surface at a vertex end of the truncated conical shape and a cone axis, the acoustically reflective body having an opening in the top surface centered on the cone axis; and an acoustically absorbing material disposed at the opening in the top surface.

2. The omni-directional acoustic deflector of claim 1 wherein the substantially conical outer surface comprises a non-linear slant profile.

3. The omni-directional acoustic deflector of claim 1 wherein the acoustically absorbing material comprises a foam.

4. The omni-directional acoustic deflector of claim 1 wherein the acoustically absorbing material comprises an acoustically absorbing fabric.

5. The omni-directional acoustic deflector of claim 1 wherein the acoustically reflective body comprises at least one opening disposed along a circumference of the substantially conical outer surface at a cone radius associated with a pressure maximum of an acoustic resonance mode.

6. The omni-directional acoustic deflector of claim 5 wherein the acoustic resonance mode is a circularly symmetric mode.

7. The omni-directional acoustic deflector of claim 1 wherein the acoustically reflective body comprises an opening extending around a circumference of the conical outer surface at a cone radius associated with a pressure maximum of an acoustic resonance mode.

8. The omni-directional acoustic deflector of claim 7 wherein the acoustic resonance mode is a circularly symmetric mode.

9. The omni-directional acoustic deflector of claim 5 further comprising an acoustically absorbing material disposed at the at least one opening.

10. The omni-directional acoustic deflector of claim 7 further comprising an acoustically absorbing material disposed at the opening extending around the circumference of the conical outer surface.

11. The omni-directional acoustic deflector of claim 1 wherein the conical outer surface is defined by a truncated hyperboloid of revolution.

12. The omni-directional acoustic deflector of claim 1 further comprising at least one non-circularly symmetric surface radially extending from the substantially conical outer surface.

13. A speaker system comprising:

an acoustic enclosure;

a downward firing acoustic driver disposed within the acoustic enclosure; and an omni-directional acoustic deflector disposed in the acoustic enclosure below the acoustic driver to receive acoustic energy propagating from the acoustic driver, the omni-directional acoustic deflector comprising an acoustically reflective body having a truncated conical shape including a substantially conical outer surface, a top surface and a cone axis, the acoustically reflective body having an opening in the top surface centered on the cone axis, the omni-directional acoustic deflector further comprising an acoustically absorbing material disposed at the opening in the top surface.

14. The speaker system of claim 13 further comprising at least one passive radiator.

15. The speaker system of claim 13 wherein the acoustic enclosure comprises a pair of opposing passive radiators configured to be driven by audio signals from an audio source such that each opposing pair of passive radiators are driven acoustically in phase with each other and mechanically out of phase with each other, to minimize vibration of the acoustic enclosure.

16. The speaker system of claim 13 wherein the substantially conical outer surface of the acoustic deflector comprises a non-linear slant profile.

17. The speaker system of claim 13 wherein the acoustically reflective body comprises at least one opening disposed along a circumference of the conical outer surface at a cone radius associated with a pressure maximum of an acoustic resonance mode.

18. The speaker system of claim 17 wherein the acoustic resonance mode is a circularly symmetric mode.

19. The speaker system of claim 17 further comprising an acoustically absorbing material disposed at the at least one opening.

20. The speaker system of claim 13 wherein the acoustically reflective body comprises an opening extending around a circumference of the conical outer surface at a cone radius associated with a pressure maximum of an acoustic resonance mode.

21. The speaker system of claim 20 wherein the acoustic resonance mode is a circularly symmetric mode.

22. The speaker system of claim 20 further comprising an acoustically absorbing material disposed at the opening extending around the circumference of the conical outer surface.

23. The speaker system of claim 13 further comprising at least one non-circularly symmetric surface radially extending from the substantially conical outer surface.

24. A speaker system comprising:

an acoustic enclosure;

a downward firing acoustic driver disposed within the acoustic enclosure;

an upward firing acoustic driver disposed with the acoustic enclosure and adjacent to the downward firing acoustic driver; and a first omni-directional acoustic deflector disposed in the acoustic enclosure below the downward firing acoustic driver to receive acoustic energy propagating therefrom and a second omni-directional acoustic deflector disposed in the acoustic enclosure above the upward firing acoustic driver to receive acoustic energy propagating therefrom, the first and second omni-directional acoustic deflectors each comprising an acoustically reflective body having a truncated conical shape including a substantially conical outer surface, a top surface and a cone axis, the acoustically reflective body having an opening in the top surface centered on the cone axis, each of the omni-directional acoustic deflectors further comprising an acoustically absorbing material disposed at the opening in the top surface.

25. The speaker system of claim 24 wherein the acoustically reflective body of each of the first and second omni-directional acoustic deflectors comprises at least one opening disposed along a circumference of the conical outer surface at a cone radius associated with a pressure maximum of an acoustic resonance mode.

26. The speaker system of claim 25 wherein the acoustic resonance mode is a circularly symmetric mode.

27. The speaker system of claim 25 further comprising an acoustically absorbing material disposed at the at least one opening.

28. The speaker system of claim 25 further comprising at least one non-circularly symmetric surface radially extending from the substantially conical outer surface.

* * * * *